US008266862B2

(12) United States Patent
Huang

(10) Patent No.: US 8,266,862 B2
(45) Date of Patent: Sep. 18, 2012

(54) PREFABRICATED WALL/FLOOR PANEL

(76) Inventor: Chien-Hua Huang, Pingtung (TW)

( * ) Notice: Subject to any disclaimer, the term of this patent is extended or adjusted under 35 U.S.C. 154(b) by 43 days.

(21) Appl. No.: 12/779,043

(22) Filed: May 13, 2010

(65) Prior Publication Data

US 2011/0277414 A1 Nov. 17, 2011

(51) Int. Cl.
*E04B 2/00* (2006.01)

(52) U.S. Cl. ..... 52/585.1; 52/436; 52/562; 52/592.3; 52/592.5; 52/604

(58) Field of Classification Search ..... 52/436–439, 52/562–564, 592.4–592.6, 585.1, 604
See application file for complete search history.

(56) References Cited

U.S. PATENT DOCUMENTS

| | | | | | |
|---|---|---|---|---|---|
| 1,171,191 | A | * | 2/1916 | Gronert | 52/591.1 |
| 1,422,949 | A | * | 7/1922 | Evans | 52/591.4 |
| 1,434,378 | A | * | 11/1922 | Evans | 52/604 |
| 1,884,319 | A | * | 10/1932 | Smith | 52/405.2 |
| 2,558,630 | A | * | 6/1951 | Stewart | 52/436 |
| 2,655,032 | A | * | 10/1953 | Zagray | 52/591.1 |
| 2,684,589 | A | * | 7/1954 | Perreton | 52/591.2 |
| 2,696,102 | A | * | 12/1954 | Zagray | 52/436 |
| 2,749,739 | A | * | 6/1956 | Zagray | 52/286 |
| 2,882,715 | A | * | 4/1959 | Zagray | 52/436 |
| 3,222,830 | A | * | 12/1965 | Ivany | 52/100 |
| D210,073 | S | * | 2/1968 | Wright | D25/118 |
| 3,609,926 | A | * | 10/1971 | Muse | 52/439 |
| 3,936,987 | A | * | 2/1976 | Calvin | 52/309.1 |
| 4,075,808 | A | * | 2/1978 | Pearlman | 52/439 |
| 4,319,440 | A | * | 3/1982 | Rassias et al. | 52/438 |
| 4,485,604 | A | * | 12/1984 | Palamara et al. | 52/436 |
| 4,850,170 | A | * | 7/1989 | Douglas et al. | 52/427 |
| 5,465,542 | A | * | 11/1995 | Terry | 52/309.7 |
| 5,685,119 | A | * | 11/1997 | Zschoppe | 52/592.5 |
| 5,715,635 | A | * | 2/1998 | Sherwood | 52/286 |
| 5,802,792 | A | * | 9/1998 | Fielding et al. | 52/396.09 |
| 5,802,797 | A | * | 9/1998 | Storer-Folt | 52/604 |
| 5,921,046 | A | * | 7/1999 | Hammond, Jr. | 52/564 |
| 6,000,186 | A | * | 12/1999 | Fielding et al. | 52/564 |
| 6,189,282 | B1 | * | 2/2001 | VanderWerf | 52/582.1 |
| 6,253,519 | B1 | * | 7/2001 | Daniel | 52/591.1 |
| 6,467,229 | B2 | * | 10/2002 | Azar | 52/589.1 |
| 6,539,682 | B1 | * | 4/2003 | Ryder | 52/437 |
| 6,962,028 | B2 | * | 11/2005 | Banova | 52/592.5 |
| 7,313,890 | B2 | * | 1/2008 | Clarke | 52/233 |
| 2003/0079432 | A1 | * | 5/2003 | Azar | 52/604 |
| 2004/0020145 | A1 | * | 2/2004 | Matsufuji | 52/223.7 |
| 2007/0251182 | A1 | * | 11/2007 | Van Steinburg | 52/586.1 |
| 2008/0148676 | A1 | * | 6/2008 | Azar | 52/604 |
| 2009/0113835 | A1 | * | 5/2009 | Banova | 52/604 |

* cited by examiner

FOREIGN PATENT DOCUMENTS

| | | | | |
|---|---|---|---|---|
| DE | 3832498 | A1 | * | 4/1990 |
| GB | 2065740 | A | * | 7/1981 |
| JP | 05163771 | A | * | 6/1993 |

*Primary Examiner* — Brian Glessner
*Assistant Examiner* — Adriana Figueroa

(57) ABSTRACT

A prefabricated wall or floor panel includes a rectangular concrete section comprising a projection along one side, a recess along the other side, the recessing being complementary to the projection, a protrusion along one end, a trough along the other end, the trough being complementary to the protrusion, channels each having one end terminated at one end and the other end terminated at the other end, a first groove on each of one end and the other end extending from one side to the other side by passing the mouths of the channels, and a second groove on either side extending from one end to the other end; a rectangular surface board formed integrally with an outer surface of the concrete section; and an interconnection comprising a transverse part of and spaced longitudinal tubes each adapted to fit into the channel to connect two adjacent prefabricated components together.

3 Claims, 7 Drawing Sheets

PREFABRICATED WALL/FLOOR PANEL

BACKGROUND OF THE INVENTION

1. Field of Invention

The invention relates to prefabricated components and more particularly to an improved prefabricated wall/floor panel.

2. Description of Related Art

Prefabrication is the practice of assembling components of, for example, a building in a factory, and transporting these components to a construction site where the building is to be located. Finally, the components are lifted into place and bolted together.

Prefabrication has the following advantages: Construction time is reduced. On-site construction and congestion is minimized. Construction quality is improved. Cost savings.

However, prefabrication also has the following advantages: Attention has to be paid to the strength and corrosion-resistance of the joining of prefabricated sections to avoid failure of the joint. Leaks can form at joints of prefabricated components. Transportation costs may be higher for voluminous prefabricated sections than for materials of which they are made. Large prefabricated sections require heavy-duty cranes and precision measurement and handling to place in position.

Thus, continuing improvements for prefabricated components (e.g., wall panels or floor panels) are constantly sought.

SUMMARY OF THE INVENTION

It is therefore one object of the invention to provide a prefabricated component as either a wall panel or a floor panel, comprising a rectangular concrete section comprising a projection along one side, a recess along the other side, the recessing being complementary to the projection, a protrusion along one end, a trough along the other end, the trough being complementary to the protrusion, a plurality of channels each having one end terminated at one end and the other end terminated at the other end, a first groove on each of one end and the other end extending from one side to the other side by passing the mouths of the channels, and a second groove on either side extending from one end to the other end; a rectangular surface board formed integrally with an outer surface of the concrete section wherein a first portion joining one ends of the surface board and the concrete section is uneven, a second portion joining the other ends of the surface board and the concrete section is uneven, a third portion joining one sides of the surface board and the concrete section is uneven, a fourth portion joining the other sides of the surface board and the concrete section is uneven; and an interconnection comprising a transverse part of and a plurality of spaced longitudinal tubes each adapted to fit into the channel to connect two adjacent prefabricated components together.

The above and other objects, features and advantages of the invention will become apparent from the following detailed description taken with the accompanying drawings.

DETAILED DESCRIPTION OF THE INVENTION

Figures 1A, 1B, 1C:
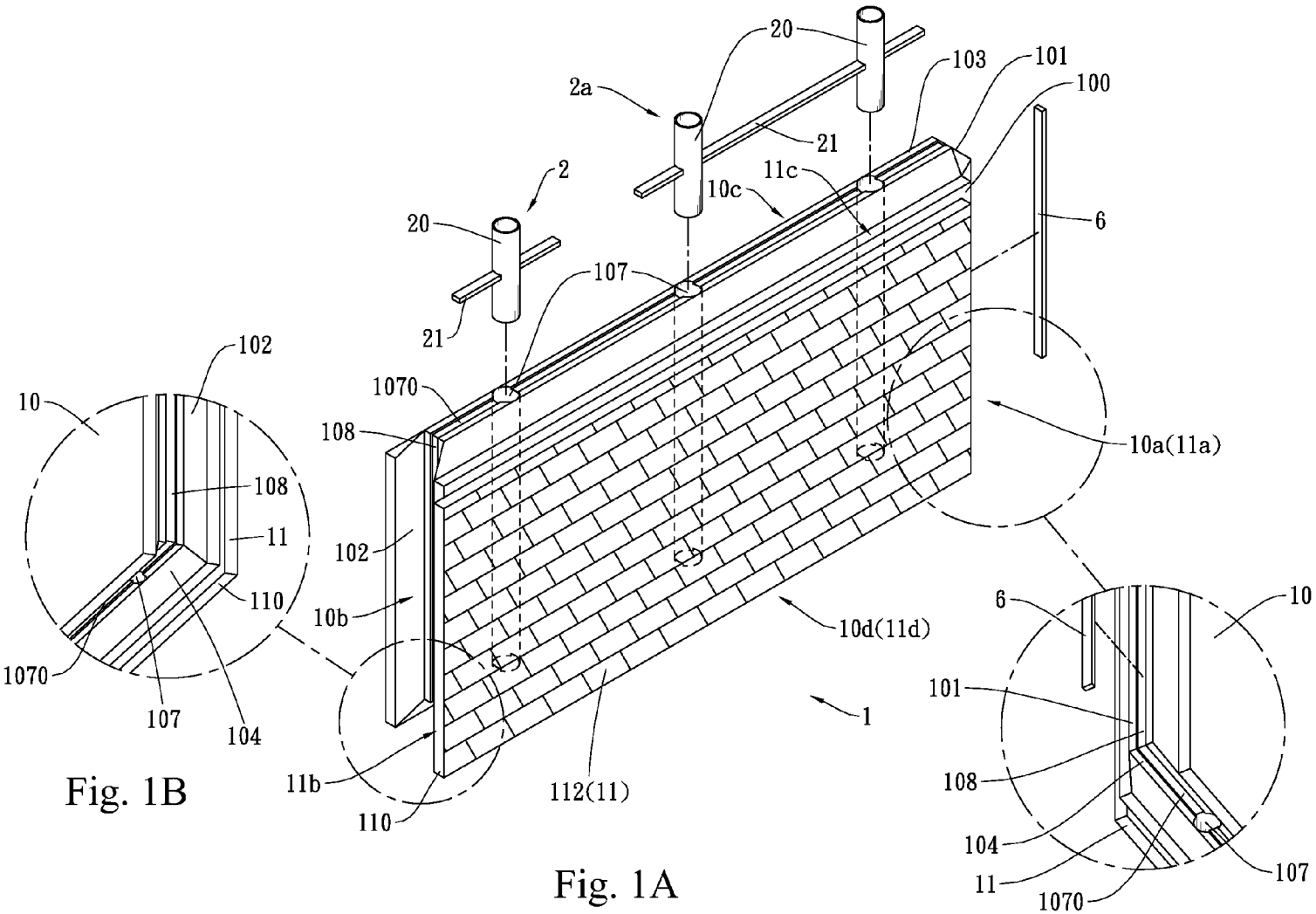
FIG. 1A is a perspective view of a prefabricated component such as a wall panel according to a first preferred embodiment of the invention.
FIG. 1B is a detailed view of the prefabricated component shown in FIG. 1A.
FIG. 1C is another detailed view of the prefabricated component shown in FIG. 1A.
Figure 2:
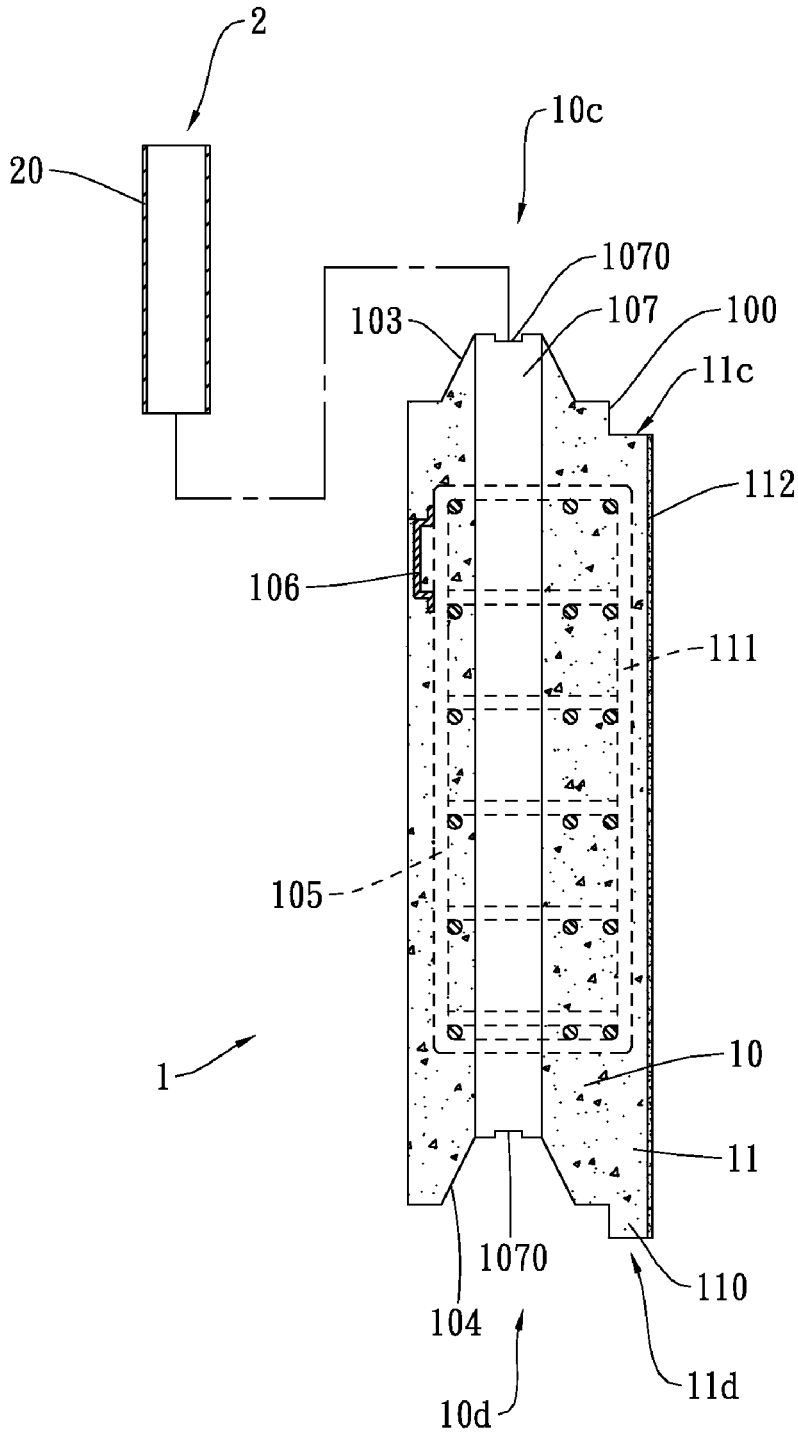
FIG. 2 is a longitudinal sectional view of the wall panel.
Figure 3:
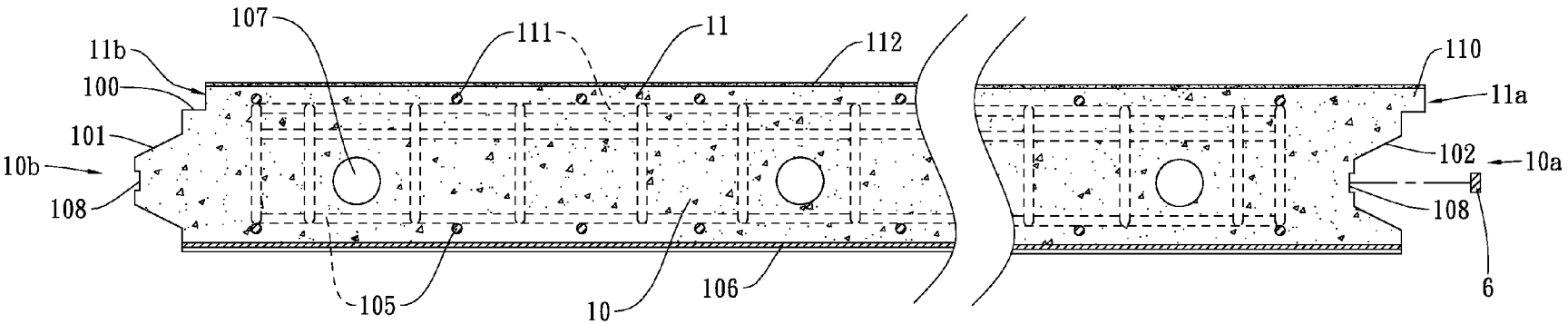
FIG. 3 is a cross-sectional view of the wall panel.

Referring to FIGS. 1 to 5, a prefabricated component (e.g., prefabricated wall panel) 1 in accordance with a first preferred embodiment of the invention comprises the following components as discussed in detail below.

A concrete section 10 and a surface board 11 are formed integrally in a mold. The concrete section 10 is a mixture of materials including cement, slaked lime, additive, ceramic, sand, glass fiber, waterproof agent, etc. The concrete section 10 is thus light-weight and waterproof. The concrete section 10 is rectangular and comprises one side 10*a* having a lengthwise projection 101, the other side 10*b* having a lengthwise recess 102 complementary to the projection 101, a top 10*c* having a lengthwise protrusion 103, and a bottom 10*d* having a lengthwise trough 104 complementary to the protrusion 103.

In the concrete section 10 there are provided with a plurality of steel posts 105 and a steel board 106 on an inner surface all for structural reinforcement. The steel board 106 may be joined with steel structure of a building. A plurality of (three are shown) straight channels 107 have one ends terminated at the top 10*c* and the other ends terminated at the bottom 10*d*. The provision of the channels 107 can increase ventilation and decrease weight of the wall panel 1, and as ducts for cables and/or wires. A lengthwise first groove 1070 on each of the top 10*c* and the bottom 10*d* extends from one side 10*a* to the other side 10*b* by passing the mouths of the channels 107. A second groove 108 on either side 10*a* or 10*b* extends from the top 10*c* to the bottom 10*d*.

An interconnection 2 has a flat transverse part 21 and a plurality of spaced longitudinal tubes 20 each fitted into the channel 107 for connecting two adjacent wall panels (e.g., wall panels 1 and 1*a*, wall panels 1 and 1*c*, wall panels 1*a* and 1*b*, and wall panels 1*b* and 1*c*) together. An elongated member 6 is complementarily disposed in the second groove 108 for compensation, stability, and structural increase purposes when two wall panels are joined together.

The surface board 11 is formed on an outer surface of the concrete section 10 and has a thickness much less than that of the concrete section 10. The surface board 11 has an outer layer 112 with patterns, ceramic tiles, etc. provided thereon, and an inner portion with steel posts 111 provided therein.

One side 11*a* of the surface board 11 and one side 10*a* of the concrete section 10 are uneven surfaces. The other side 11*b* of the surface board 11 and the other side 10*b* of the concrete section 10 are uneven surfaces. Top 11*c* of the surface board 11 and top 10*c* of the concrete section 10 are uneven surfaces. Bottom 11*d* of the surface board 11 and bottom 10*d* of the concrete section 10 are uneven surfaces. Hence, a joining portion 110 is formed by the surface board 11 and a joining section 100 complementary to the joining portion 110 is formed by the concrete section 10. The provision of the joining portion 110 and joining section 100 can facilitate a joining of two adjacent surface boards 11.

Figure 4:
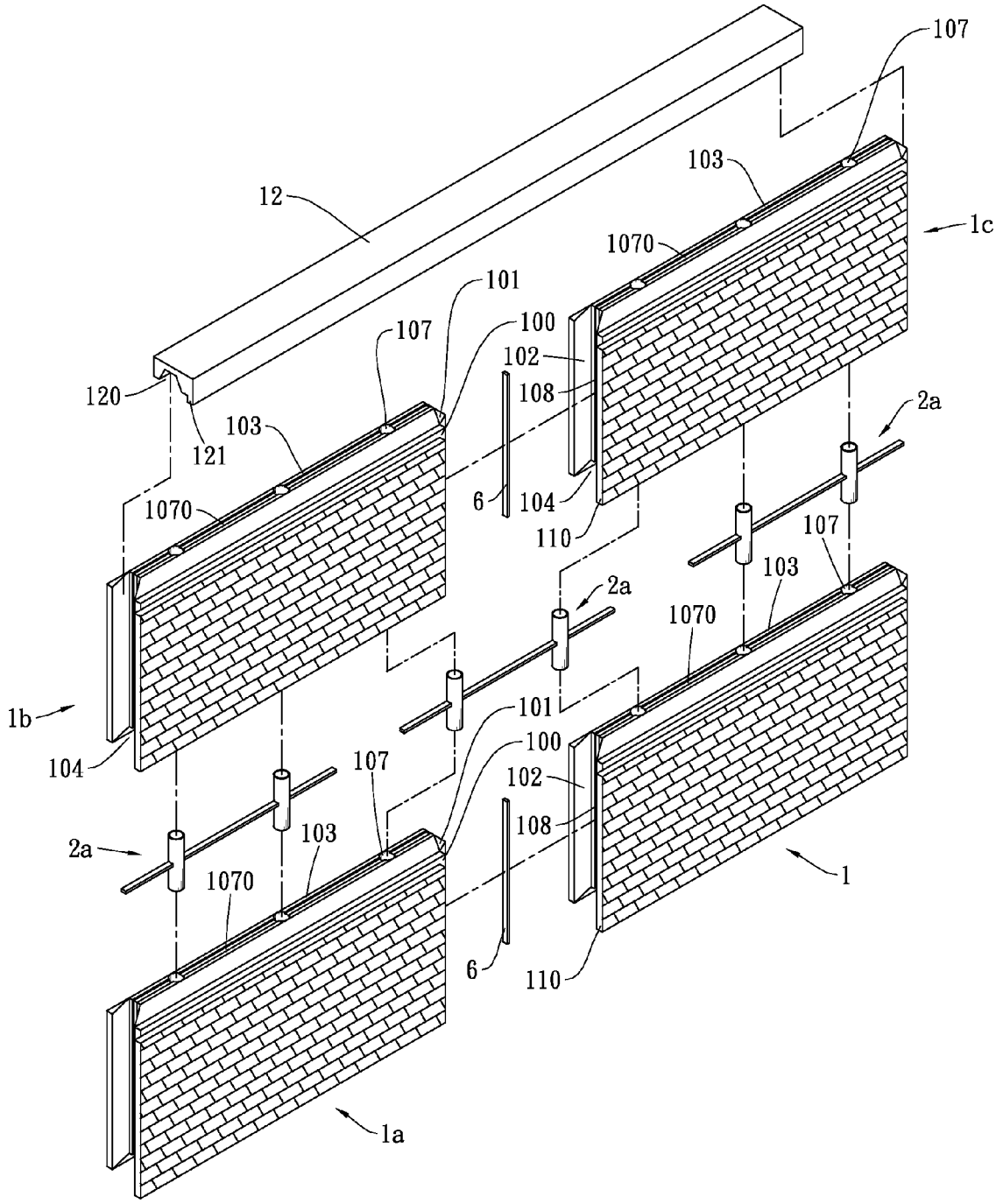
FIG. 4 is an exploded view showing four wall panels to be assembled.

As shown in FIG. 4, for upper two wall panels 1*b*, 1*c*, the projection 101 of the wall panel 1*b* is fitted into the recess 102 of the wall panel 1*c*, and a member 6 is fitted in the second groove 108 for stably fastening the wall panels 1*b*, 1*c* together. For lower two wall panels 1*a*, 1, the projection 101 of the wall panel 1*a* is fitted into the recess 102 of the wall panel 1, and a member 6 is fitted in the second groove 108 for stably fastening the wall panels 1*a*, 1 together.

For two wall panels 1*b*, 1*a* at one side, an interconnection 2*a* has its tubes fitted in the channels 107 of both the wall panels 1*b*, 1*a* to connect them together. For two wall panels 1*c*, 1 at the other side, the interconnection 2*a* has its tubes fitted in the channels 107 of both the wall panels 1*c*, 1 to connect them together. Moreover, the interconnection 2*a* has its tubes fitted in the channels 107 of the wall panels 1, 1*a*, 1*b*, and 1*c* to connect them together. Moreover, adhesive may be applied between joining portions of any two adjacent wall panels for further bonding them together, for leak prevention, etc.

Moreover, an elongated head member 12 has a groove bottom 120 complementary to that of the protrusions 103, and a protuberance 121 beside the bottom 120, the protuberance 121 being complementary to the joining section 100. The provision of the head member 12 is for aesthetic purposes.

Figure 5:
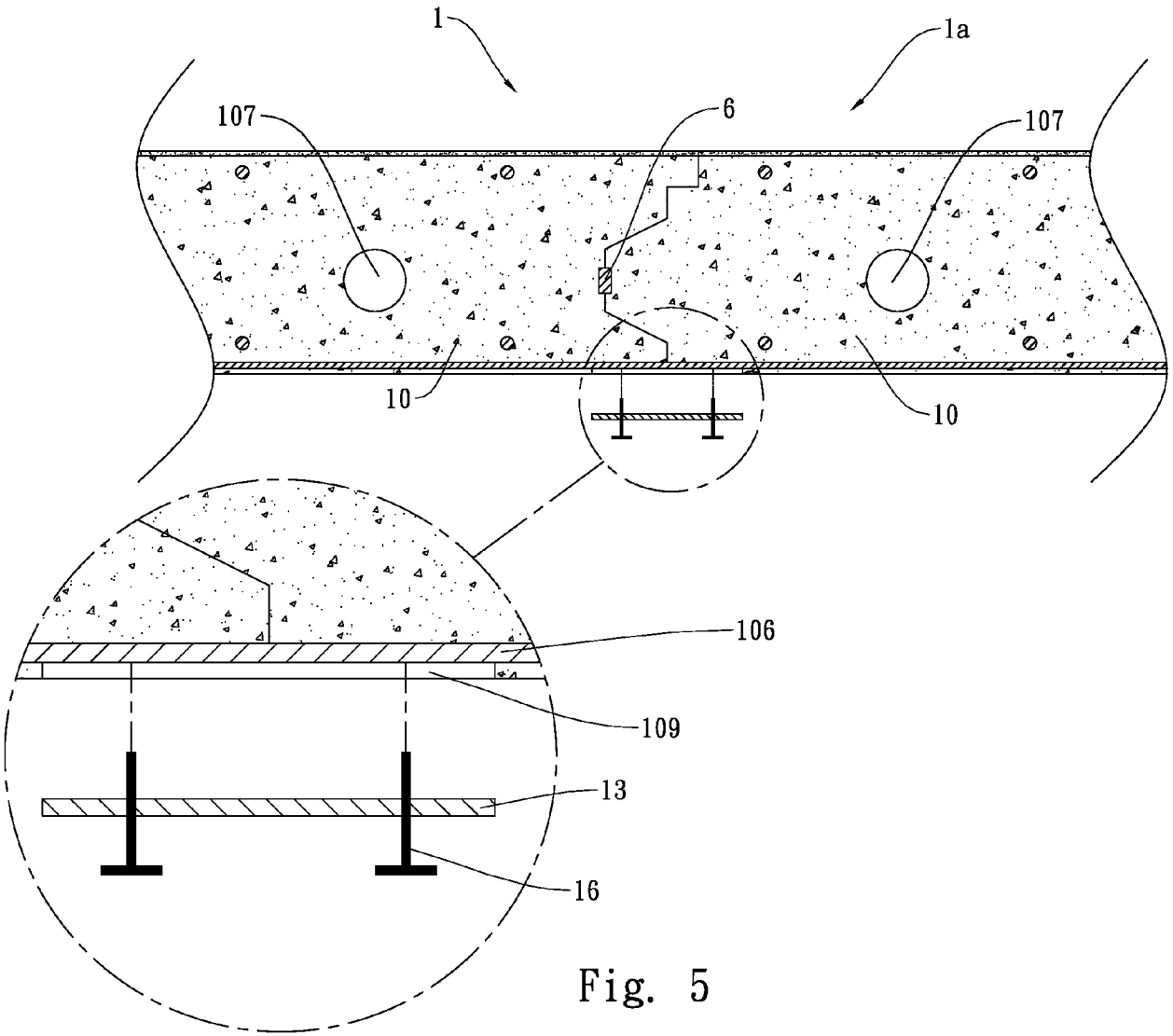
FIG. 5 is a cross-sectional view of the joining portion of two wall panels shown in FIG. 4 where additional joining members are shown.

As shown in FIG. 5, an additional joining arrangement may be provided. A first half recess is provided on the steel board 106 of wall panel 1 and a second recess is provided on the steel board 106 of wall panel 1*a*. The first and second recesses together form a recess 109. A plate 13 can be fitted in the recess 109 to form a flat surface on the joining portion of the wall panels 1, 1*a*. Moreover, two fasteners 16 are driven through the plate 13 into the steel board 106 to fasten them together.

Figure 6:
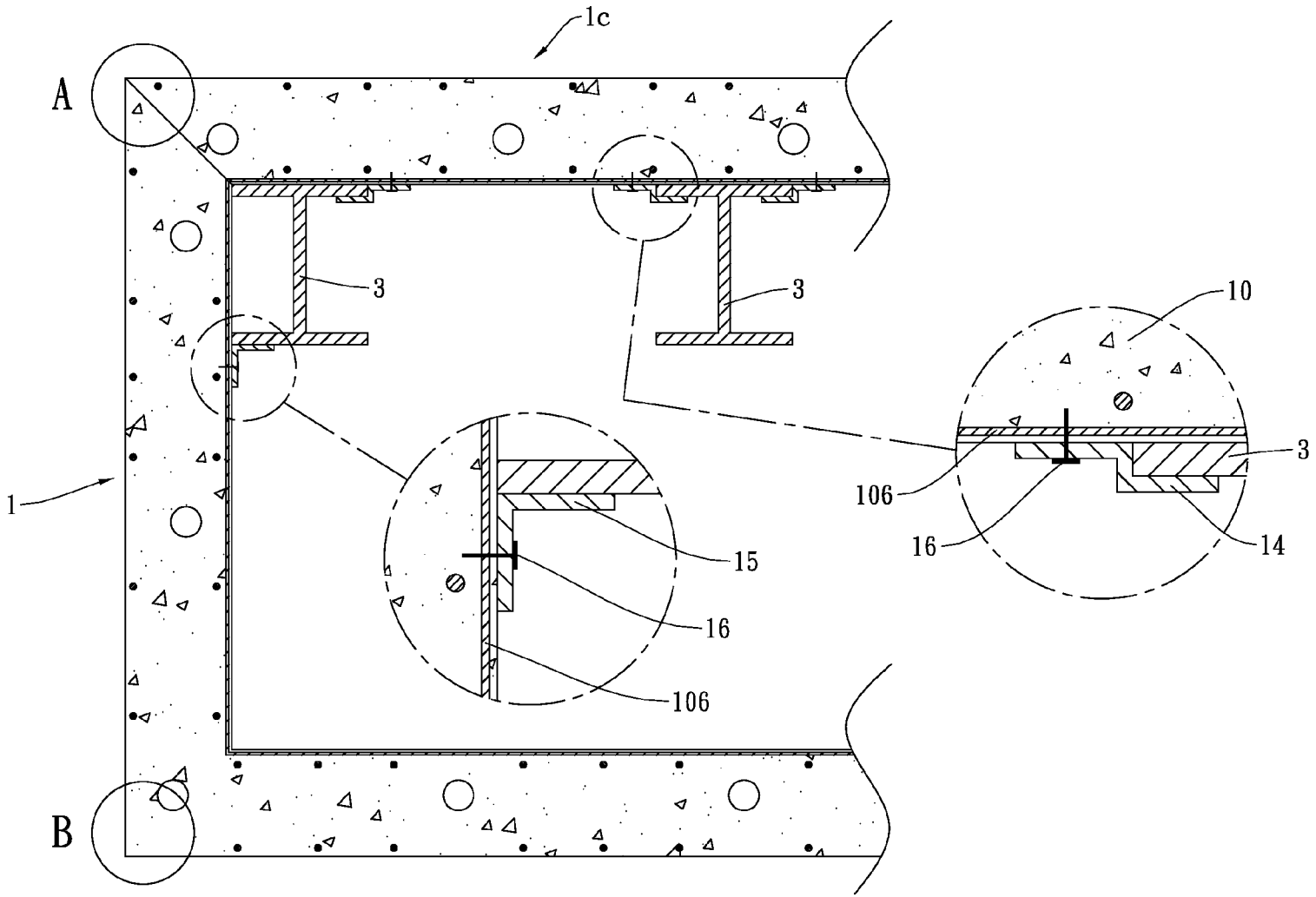
FIG. 6 is a cross-sectional view of a prefabricated component according to a second preferred embodiment of the invention.

Referring to FIG. 6, a prefabricated component according to a first configuration of a second preferred embodiment of the invention is a wall panel 1 having a 90 degrees bent corner (see B). A second configuration of the prefabricated component is a wall panel 1*c* having a cut side and a wall panel 1 having a cut side together they form a 90 degrees bent corner (see A). An I-shaped steel member 3 is disposed at an inner surface of the corner A. A fastener 16 is driven through a member 15 having a section of L into the steel board 106 to fasten the I-shaped steel member 3 and the wall panel 1 together. A bent member 14 has one part put on an I-shaped steel member 3. Another fastener 16 may driven through the other part of the bent member 14 put on the steel board 16 to fasten the I-shaped steel member 3 and the wall panel 1*c* together.

Figure 7:
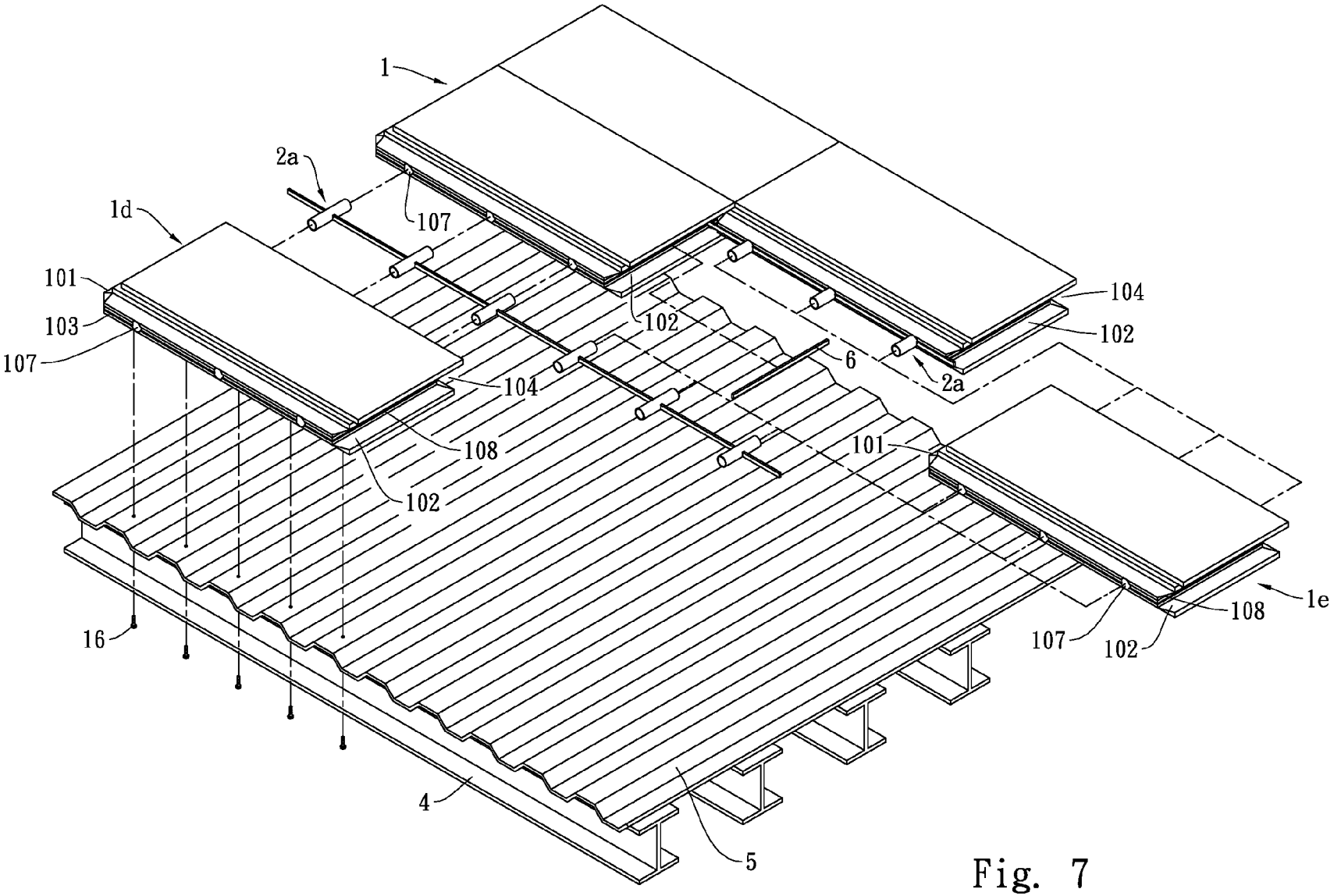
FIG. 7 is an exploded perspective view showing five prefabricated components such as floor panels according to a third preferred embodiment of the invention being assembled.

Referring to FIG. 7, it shows five prefabricated components 1, 1*e*, and 1*d* (e.g., floor panels) according to a third preferred embodiment of the invention. A plurality of parallel I-beams 4 are positioned on the floor. A corrugated steel board 5 is placed on the I-beams 4. The floor panels 1, 1*e*, and 1*d* are assembled in a manner the same as that described with respect to the first embodiment. Finally, a plurality of fasteners 16 are driven through the steel board 5 into the floor panels 1, 1*e*, and 1*d* to fasten them together. As a result, a floor is complete.

While the invention herein disclosed has been described by means of specific embodiments, numerous modifications and variations could be made thereto by those skilled in the art without departing from the scope and spirit of the invention set forth in the claims.

What is claimed is:

1. A prefabricated component as either a wall panel or a floor panel, comprising:

a rectangular concrete section comprising a projection along a first side, a recess along a second side opposite the first side, the recess being complementary to the projection, a protrusion along a first end, a trough along a second end opposite the first end, the trough being complementary to the protrusion, a plurality of channels each having an end terminating at the first end and another end terminating at the second end, a first groove on each of the first end and the second end extending from the first side to the second side by passing mouths of the channels, and a second groove on each of the first side and the second side extending from the first end to the second end;

a rectangular surface board formed integrally with an outer surface of the concrete section wherein a first portion joining a first end of the surface board and the concrete section is uneven, a second portion joining a second end of the surface board and the concrete section is uneven, a third portion joining a first side of the surface board and the concrete section is uneven, a fourth portion joining a second side of the surface board and the concrete section is uneven;

a plurality of steel posts forming a reinforcing mesh disposed in the rectangular surface board and the rectangular concrete section; and an interconnection comprising a transverse part and a plurality of spaced longitudinal tubes each adapted to fit into the channel to connect at least two adjacent prefabricated components together.

2. The prefabricated component of claim 1, further comprising a member adapted to be disposed in the second groove.

3. The prefabricated component of claim 1, wherein the surface board comprises an outer layer and a reinforced inner portion.

* * * * *